US005185965A

United States Patent [19]

Ozaki

[11] Patent Number: 5,185,965

[45] Date of Patent: Feb. 16, 1993

[54] METHOD AND APPARATUS FOR GRINDING NOTCHES OF SEMICONDUCTOR WAFER

[75] Inventor: Haruo Ozaki, Hachioji, Japan

[73] Assignees: Daito Shoji Co., Ltd., Osaka; Emtec Co., Ltd., Tokyo, both of Japan

[21] Appl. No.: 729,291

[22] Filed: Jul. 12, 1991

[51] Int. Cl.[5] ..... B24B 9/06

[52] U.S. Cl. ..... 51/283 E; 51/48 R; 51/50 R; 51/165.8

[58] Field of Search ..... 51/35, 48 R, 50 R, 165.71, 51/165.77, 165.8, 283 R, 283 E, 284 E

[56] References Cited

U.S. PATENT DOCUMENTS 3,809,050 5/1974 Chough et al. ..... 51/216 R
4,864,779 9/1989 Ozaki ..... 51/283 R
4,905,425 3/1990 Sekigawa et al. ..... 51/165.77

*Primary Examiner*—M. Rachuba
*Attorney, Agent, or Firm*—Armstrong, Westerman, Hattori, McLeland & Naughton

[57] ABSTRACT

A method of grinding the notch of a thin workpiece, for example, a semiconductor wafer in the circumferential direction and the thickness direction by arranging a rotating disk-form grinding wheel and a semiconductor wafer to be ground with said wheel in such positions that the respective planes orthogonally cross with each other, moving said wheel in an axial direction of the spindle or rotating said semiconductor wafer upon the center thereof, moving said semiconductor wafer in a direction of approach to or alienation from said wheel, and moving said wheel in a direction to cross orthogonally with said axial line direction and direction of approach to or alienation from said wheel, and an apparatus therefor.

3 Claims, 5 Drawing Sheets

METHOD AND APPARATUS FOR GRINDING NOTCHES OF SEMICONDUCTOR WAFER

BACKGROUND OF THE INVENTION:

1. Industrial useful field

The present invention relates to a method and apparatus for grinding notches of a disc form workpiece, e.g. a semiconductor silicon wafer. More specifically, the invention relates to a method and apparatus for grinding notches of a semiconductor wafer so as to perform chamfering thereof in a circumferential direction of the notches as well as in the plate thickness direction of the notched semiconductor wafers by moving a rotating grinding wheel in a direction of an axial line (direction X) of the rotary shaft thereof or rotating said wafer around the center axis thereof (direction $\theta$), moving the wafer in a direction of approach to or alienation from the wheel (direction Y) and moving said wheel in a direction (direction Z) to cross orthogonally with said directions X and Y.

2. Description of Prior Art

The "semiconductor wafer" as referred to in this invention covers a thin disk of semiconductor material, exemplarily silicon, which is normally obtained by slicing a cylindrical refined single crystal mass, for example, silicon mass as shown in FIG. 6. Its surface is polished into mirror face, on which various semiconductor devices are formed by various etching technics, lithography, etc. A semiconductor wafer is a thin disk having its sizes of, for example, 10–400 mm in diameter, 200 μm–10 mm in thickness. In order to facilitate aligning the circumferential direction, the wafer is provided with an orientation flat (OF) forming a linear portion on a part of its periphery or a nearly V-notch.

On the other hand, during fine machining of the surface of a semiconductor wafer, occurrence of fly dust on the surface or outer periphery of the semiconductor wafer becomes a serious matter of great concern. If a semiconductor wafer has a sharp portion on its outer periphery, a large amount of dust is produced. Accordingly, elimination of sharpness on a boundary face portion between the orientation flat or a notch and an outer pheripheral face, especially extending the plate thickness of the orientation flat or the notch, is an effective means of preventing flying of dust.

To process an orientation flat or a notch in an accurate dimension leads to reduction of labor for location of the workpiece to be machined in the subsequent fine finemachining step. Accordingly, grinding of orientation flat or notch is required to be performed in as high accuracy as possible.

Conventionally, due to the difficulty of removing the sharp edges of the nearly V-notch, an orientation flat which is considered readily machinable has frequently been used. However, the orientation flat has a drawback that it requires a large portion to be cut off in working, so that effective utilization of precious semiconductor wafer is prevented.

As a method of grinding the notch, conventionally chemical polishing or contoured blade has been adopted. The chemical polishing process is, as shown in FIG. 6, to immerse a disk-form semiconductor wafer 2 sliced off from a cylindrical ingot of a semiconductor material, for example silicon 1 in an etching liquid to remove chemically the edge portion 2*a* having various defects, e.g. processing strain, crystal defect, etc. The said process has defects such that, as shown in FIG. 7, erosion occurs not only in the edge portion 2*a* but also in the whole area 2*b* immersed in the etching liquid to become thin, so that the flatness of the wafer is degraded to provide undesirable effect on the fine processing in the next step. Further, the said process has such defect that it is very small amount of processing and allows only insufficient processing to prevent flying of submicron dust which is problematic in processing super LSI and the like.

In the form grinding method, grinding notch 2*c* may be performed with a cutter having the same shape as the required notch 2*c* to be chamfered so that the corresponding cutter must be prepared on each occasion where the shape of the notch 2*c* is changed. Further, as the shape of said cutter changes as the frequency of use of the cutter for grinding increases, the cutter which has been used to some extent requires to be replaced by a new cutter. Thus, the form grinding method has defects in that it is economically expensive, and it requires many steps for the setup work. Further, as it is not possible to carry out chamfering of the edges of the V-notch 2*c* on the outer periphery 2*d* of the wafer 2 with a single grinding stone, normally the chamfering in the direction of the plate thickness only is carried out, and fine machining is obliged to carry out in the next step. However, due to the generation of dust from the unprocessed edge portion 2*a* in the circumferential direction, there has been a defect of having significant adverse effect such as to cause breakage of the lead wire on said wafer.

OBJECTS OF THE INVENTION

The present invention intends to eliminate the abovementioned defects of prior art.

An object of the present invention is to enable chamfering of a notched workpiece sufficient to inhibit generation of dust while keeping the flatness of the face of the thin workpiece, exemplarily the semiconductor wafer in a good condition even for the portion which has been difficult to work by a conventional process, on the surface of which fine processing shall be produced in the subsequent step, which is realized either by feeding straightly said semiconductor wafer held in a position orthogonal to a rotating grinding wheel in the direction of approach to or alienation from said wheel while feeding straightly the wheel in the axial direction of its spindle, or by turning said centered semiconductor wafer at an angle with a slow speed, thereby moving the grinding face of the wheel relatively to the semiconductor wafer so as to follow the contour of the V shaped notch to be chamfered.

Another object of the present invention is to make it possible to carry out efficient chamfering without any setup by requiring no replacement of the wheel even when the shape of the notch is changed.

A further object of the present invention is to improve the work efficiency by making it possible to carry out chamfering in both the circumferential direction and the plate thickness direction of the notch with a single wheel having a large diameter, and to prevent generation of dust from the edge portion, thereby preventing an undesirable effect upon quality and performance of the devices to be formed on the chamfered semiconductor wafer.

SUMMARY OF THE INVENTION

In order to accomplish the above mentioned objects, this invention provides a method for chamfering the notched portion of a thin disk-form workpiece, exemplarily a notched semiconductor wafer in the circumferential direction and the thickness direction thereof, comprising arranging a grinding wheel and a workpiece in such positions that their flat faces orthogonally cross with each other; feeding straightly said wheel in an axial direction of the spindle thereof (direction X); feeding straightly said workpiece in a direction approach to and alienation from said wheel (direction Y); and feeding straightly said wheel in a direction (direction Z) to cross orthogonally with said axial direction (direction X) and said direction of approach to and alienation from said wheel (direction Y); thereby carrying out chamfer processing of the outer peripheral part of the notch of said workpiece in the peripheral direction and the thickness direction thereof.

The present invention provides another method for chamfering the notched portion of the above-mentioned workpiece, comprising arranging a grinding wheel and a workpiece in such positions that their flat faces orthogonally cross with each other; rotating said workpiece on the center axis thereof (direction $\theta$) with a slow speed; feeding straightly said workpiece in a direction of approach to and alienation from said wheel (direction Y); and feeding straightly said wheel in a direction (directions Z) to cross orthogonally with the direction of approach to and alienation from said workpiece (direction Y); thereby carrying out chamfer processing of the outer peripheral part of the notch of said workpiece in the outer peripheral direction and the plate thickness direction.

Further, the invention provides an apparatus for grinding a notch of a disk form workpiece, specifically for chamfering an outer peripheral part of the notched semiconductor wafer with a disk-form grinding wheel, comprising a carriage supporting said wheel; a first driving mechanism for feeding straightly the wheel mounted on said carriage in an axial direction of the spindle of said wheel (direction X); a workpiece holder for centering said workpiece at a position wherein the plane of the workpiece to be chamfered orthogonally crosses with the plane of said wheel; a second driving mechanism for moving straightly said carriage in a direction (direction Z) to cross orthogonally with the direction of bringing the workpiece centered and held on said workpiece holder into approach to and alienation from said wheel (direction Y); a third driving mechanism for turning said workpiece holder to turn the workpiece held thereon at a desired angle ($\theta$) with a slow speed; a forth driving mechanism for moving said workpiece holder so as to feed straightly the workpiece held on said holder in a direction of approach to and alienation from said wheel (direction Y); and a control unit for controlling said first, second, third and forth driving mechanism; wherein chamfer processing of the peripheral part of the notch of said workpiece is carried out in the circumferential direction and the thickness direction of the workpiece by moving straightly said wheel and said workpiece so as to make relative displacements in the triaxial directions (directions X or $\theta$, Y and Z) by means of said control unit.

BRIEF DESCRIPTION OF THE DRAWINGS

FIGS. 1 through 6 relate to the embodiments of the present invention; in which FIG. 1 is a perspective view of a semiconductor wafer to be ground and an apparatus for grinding notches of semiconductor wafer;

FIG. 2 is a plan view of the essential parts of the grinding apparatus;

FIG. 3 is an enlarged plan view of the essential part of the semiconductor wafer showing the chamfering processing condition in the circumferential direction thereof;

FIG. 4 is an enlarged partial vertical sectional side view of the essential part of the semiconductor wafer showing the chamfering processing condition in the plate thickness direction thereof;

FIG. 5 is a partially enlarged vertical sectional side view of the essential part of the chamfered edge portion of the semiconductor wafer provided with the chamfering processing in the plate thickness direction;

FIG. 6 is a perspective view showing the condition of the semiconductor wafer sliced off from the cylindrical base material.

DETAILED DESCRIPTION OF THE INVENTION

Figure 1:
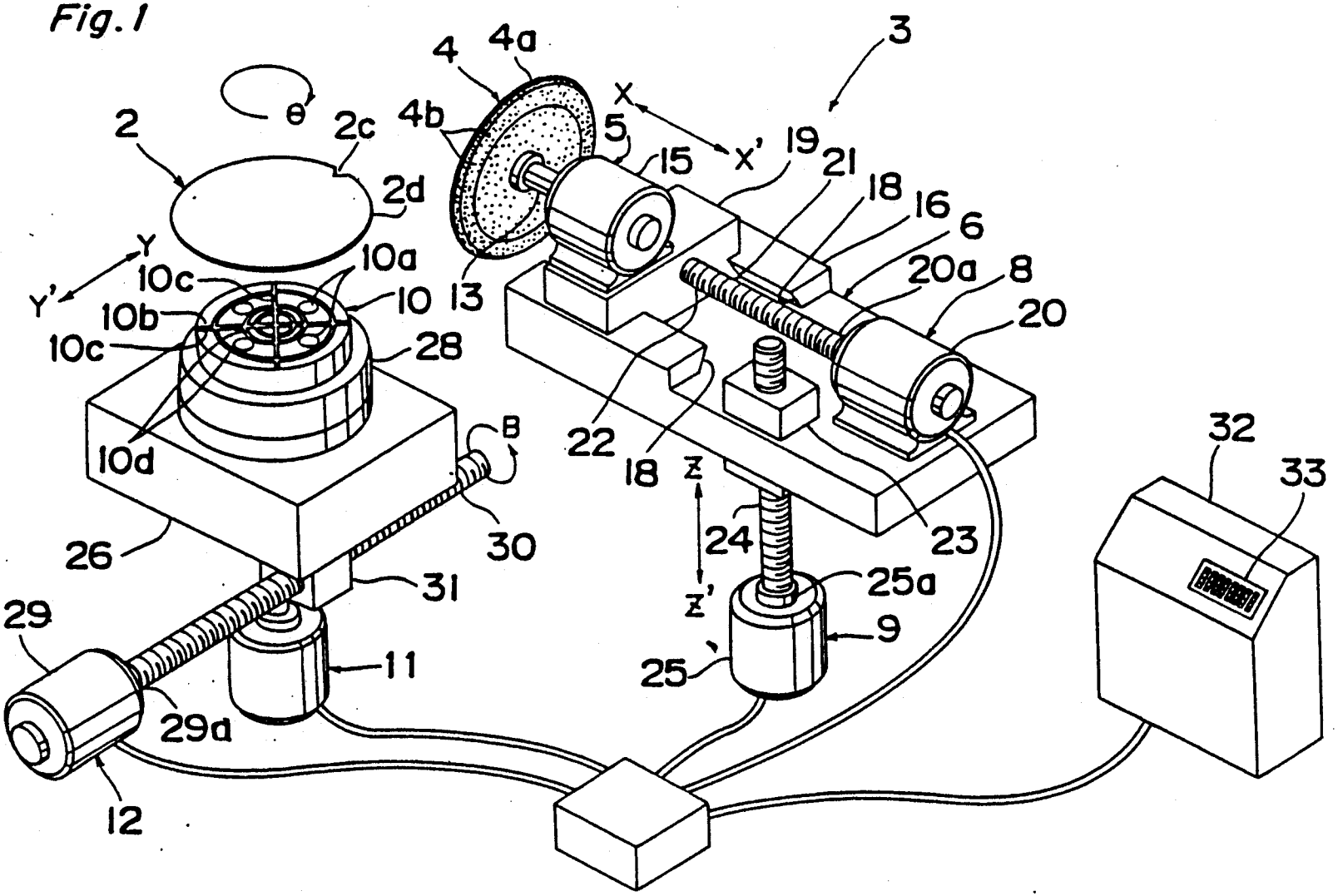

Hereinafter, the present invention is explained based on the embodiment shown in the drawings. The apparatus for grinding notches of a semiconductor wafer 3 according to the present invention is furnished with a disk-form wheel 4, a wheel rotation driving mechanism 5, a carriage 6 for loading said rotation driving mechanism, a first driving mechanism 8, a second driving mechanism 9, a workholder 10, a third driving mechanism 11 and a fourth driving mechanism 12.

The wheel 4, being formed by solidifying diamond grains **4*b* around the wheel body 4*a* which is shaped by solidifying emery by metallizing or electrodeposition, is detachably fixed to the spindle 13 with a nut 14**.

Figure 3:
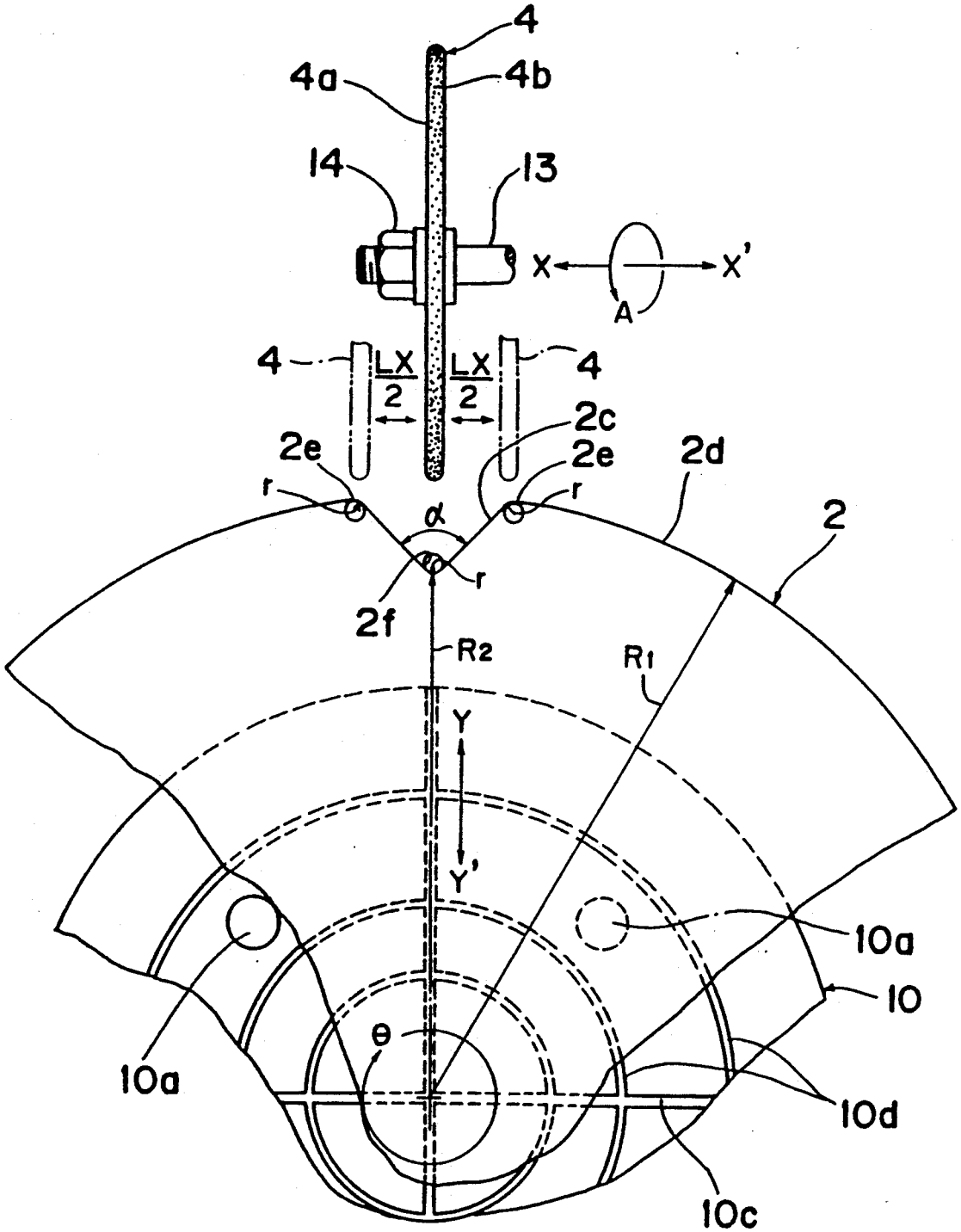

The rotation driving mechanism 5 is constituted by using an electric motor 15 and designed to rotate the wheel 4 unidirectionally on the spindle 13 coupled to the shaft of said motor 15. It is designed to turn the wheel 4 fixed to the spindle 13 for example in the direction of an arrow A as shown in FIG. 3.

The carriage 6 has a guide block 16 and a moving table 19. The moving table 19 can slide linearly through the dovetail grooves 18 formed on the guide block 16.

The first driving mechanism 8 is constituted by screw fitting the rack 21 which is connected for example to the rotary shaft **20*a* of the DC servo motor 20 to the female screw 22 formed on the moving table 19, by which the moving table 19 guided by the dovetail grooves 18 is moved in the axial direction (direction X) of the spindle 13 of the wheel 4**.

The second driving mechanism 9 is to move the wheel 4 in the direction of Z—Z', being constituted as a DC servo motor 25 in which a rotary shaft **25*a* is directly connected to the rack 24 which is rotatably screw-fitted to the feed nut 23 fixed to the guide table 16**.

Figure 2:
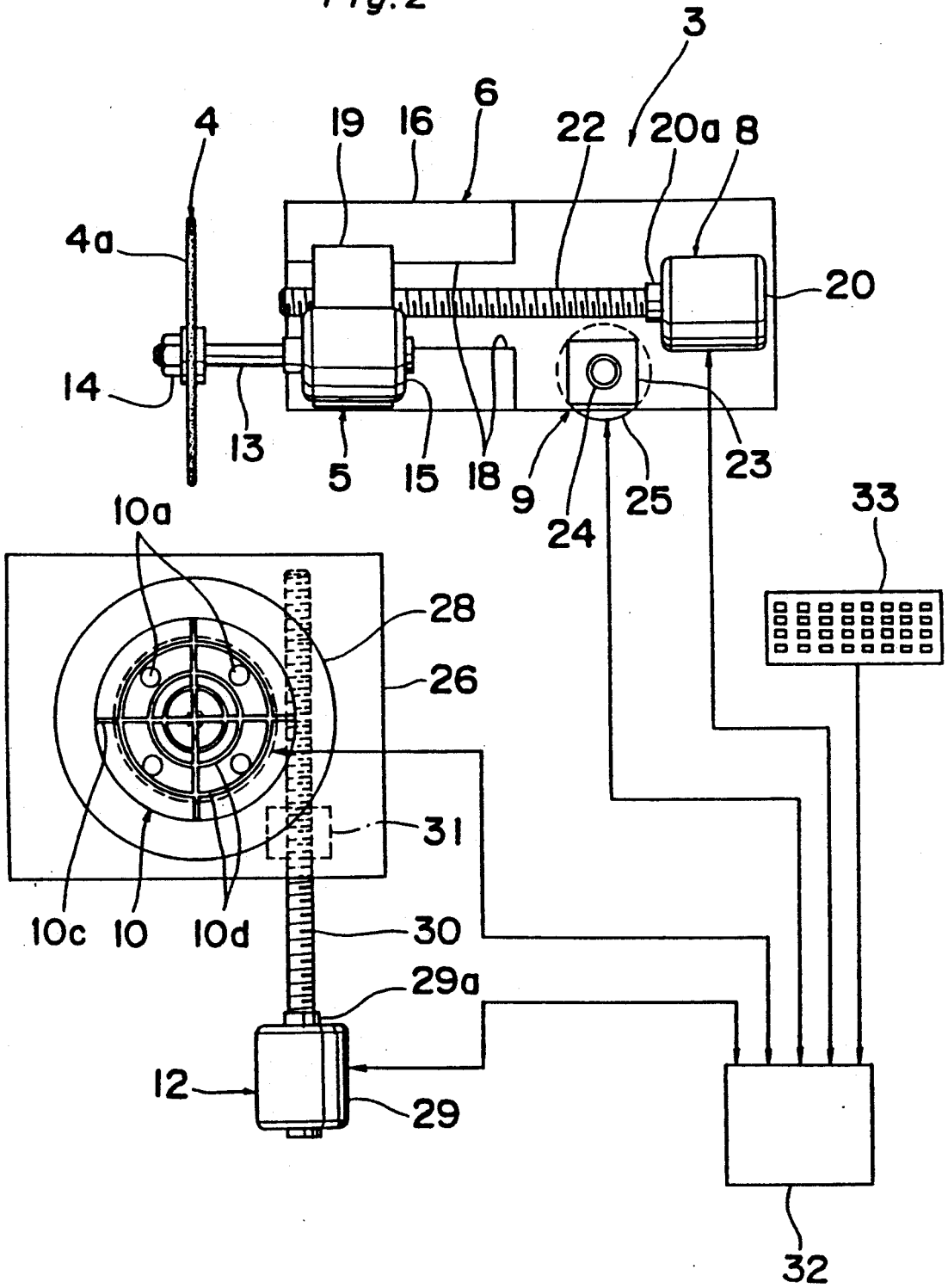

The workpiece holder 10 is provided on its upper face **10*b* with a plurality, for example, four pieces, of suction holes 10***a*, as shown in FIGS. 1 through 3. The said vacuum holes 10*a* are connected with a vacuum pump (not illustrated), so that, by the operation of said vacuum pump, air is sucked off through the suction holes 10*a* to absorb the semiconductor wafer 2. On the upper face 10*b*, there are formed a pair of slots 10*c* which are radially disposed in orthogonally crossing relations with each other and circumferential concentrical grooves 10*d*. Further, the workpiece holder 10 is freely rotatably supported by a supporting cylinder 28 which is fixed to the moving table 26. By this construction, the wafer 2 absorbed to the workpiece holder 10 is slowly rotated by the third driving mechanism 11.

The fourth driving mechanism 12 is to have the workpiece holder 10 approach to or alienate from the wheel 4, being constituted by a rack 30 fixed to the rotary shaft 29*a* of the DC servo motor 29 and a feed nut 31 which is arranged on the moving table 26 and screw-fitted to the rock 30, so that, by rotating the rack 30 in normal or reverse direction, the moving table 26 can be reciprocally moved in the direction Y.

And, the first, second, third and fourth driving mechanisms 8, 9, 11 and 12 are electrically connected to the control unit 32 having a console 33.

Further, the method according to the present invention is a method for chamfering the notch 2*c* of a semiconductor wafer 2 in the circumferential direction and the thickness direction of the wafer by arranging a rotating disk-form wheel 4 and a semiconductor wafer 2 to be ground or chamfered with said wheel 4 in such positions that the respective planes are orthogonally crossing with each other, feeding straightly said wheel 4 in a direction of axial line of the spindle 13 (direction X), feeding straightly said semiconductor wafer 2 held on the workpiece holder in a direction of approach to or alienation from said wheel 4 (direction Y), and feeding straightly said wheel 4 in a direction (direction Z) to cross orthogonally with said axial direction (direction X) and in a direction of approach to or alienation from said wheel (direction Y).

OPERATION

Figure 6:
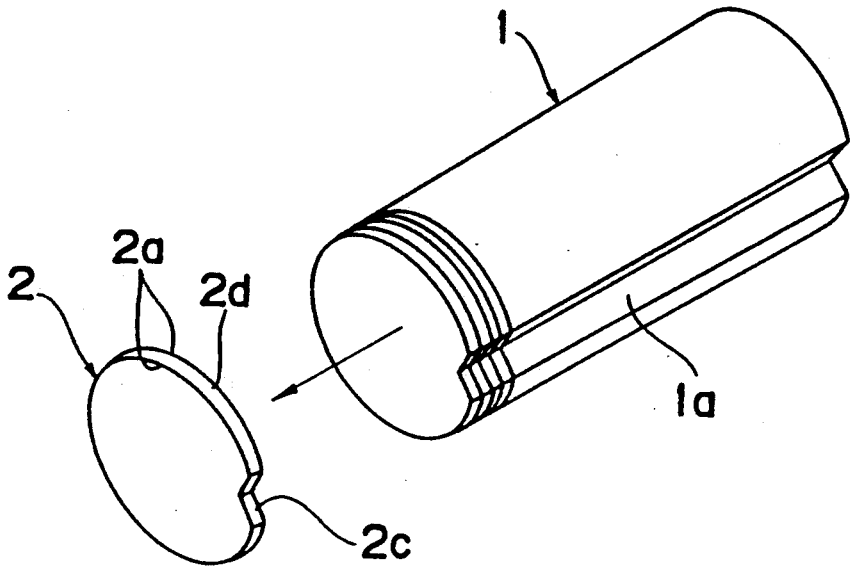
Figure 7:
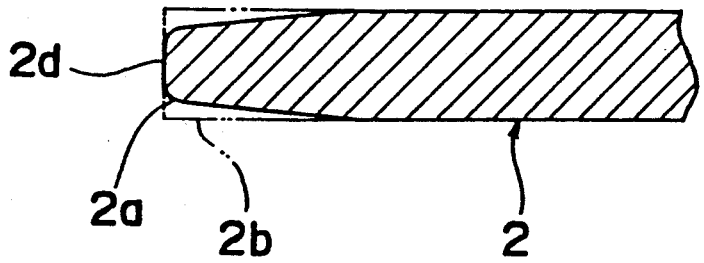
FIG. 7 is an enlarged vertical sectional side view of the essential part showing the condition of the processed edge of the wafer in chamfering by chemical polishing according to the conventional embodiment.

Hereinafter, operation of the present invention which is constituted as above is explained. Referring to FIG. 1, FIG. 2 and FIG. 6, a semiconductor wafer 2 (sliced off from a cylindrical ingot of a semiconductor material, for example, silicon 1 which is provided with a nearly V shaped notch la along the longitudinal axis of the material by slicing into a disk form) is placed on an upper face 10*b* of a workpiece holder 10, and a vacuum pump (not shown) is operated. As said vacuum pump sucks air from the suction hole 10*a*, the semiconductor wafer 2 is adsoved to the workpiece holder 10.

According to the commands derived from the control unit 32, the third driving mechanism 11 is operated to rotate the workpiece holder 10, i.e. semiconductor wafer 2, slowly at an angle in the direction of arrow $\theta$. On detection of correct facing of the notch 2*c* to the wheel 4 with a position sensor (not illustrated), the operation of the driving mechanism 11 is shut down.

Figure 4:
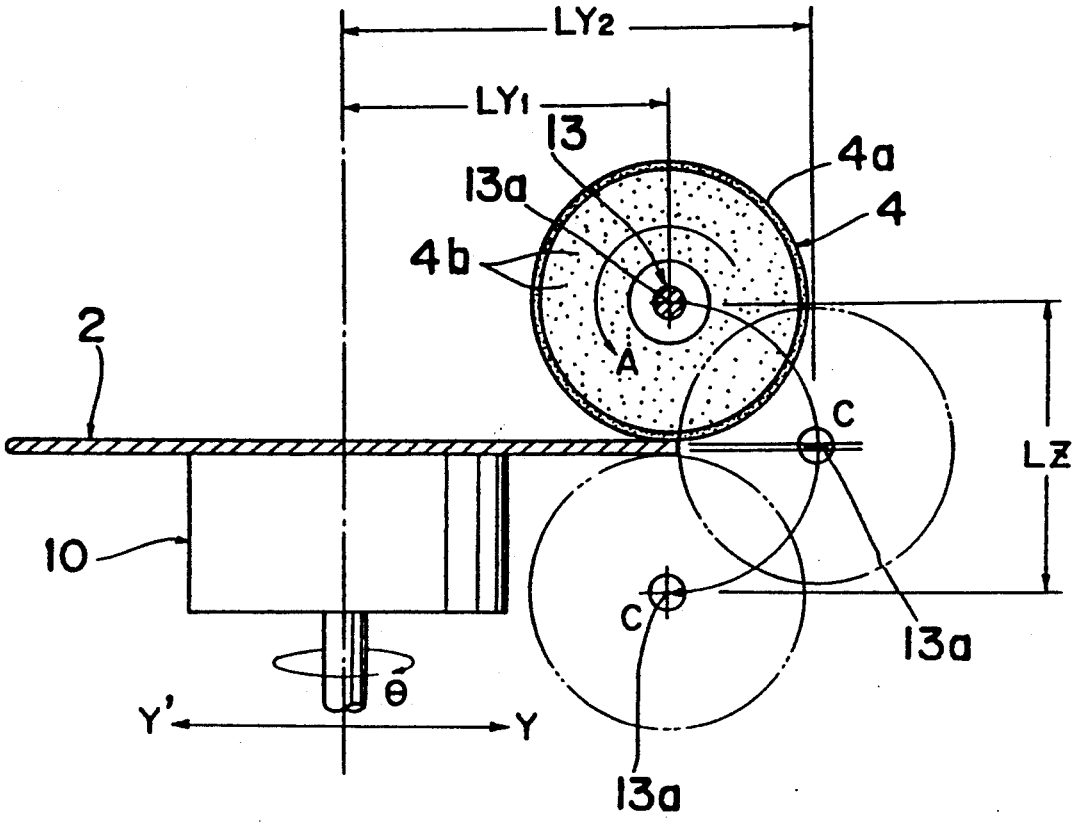

Further, by rotating the DC servo motor 25, the carriage 6 is moved up and down in the direction of arrow Z—Z' by the actions of the rack 24 and the feed nut 23 to obtain agreement between the nearly middle part of the semiconductor wafer 2 in the plate thickness direction and the axial center 13*a* of the spindle 13 of the wheel 4, as shown in the FIG. 4. At this time, the semiconductor wafer 2 leaving the wheel 4 is positioned as shown in FIG. 3, and the semiconductor wafer 2 is not yet processed. Here, when the DC servo motor 29 is operated to rotate the rack 30 in the direction of arrow B, the moving table 26 moves in the direction of arrow Y to approach the wheel 4 until the rotating wheel 4 comes into contact with the semiconductor wafer 2.

After bringing the semiconductor wafer 2 into contact with the grinding face of the wheel 4, the moving table 26 is fed to give movement of a predetermined distance in the direction of arrow Y by further driving the DC servo motor 29, and chamfering of the notch portion of the semiconductor wafer 2 is started.

First, the DC servo motor 20 is driven at a considerably slow speed. In other words, the wheel 4 fixed to the moving table 19 mounted on the carriage 6 in the direction of arrow X by the specified distance LX/2 as shown in FIG. 3. Simultaneously with this, the DC servo motor 25, accordingly the wheel 4 mounted on carriage 6 and the DC servo motor 29, accordingly the wafer 2 held on the workpiece holder 10 on the moving table 26 are moved in the direction of arrow Z or Z' and Y or Y', respectively at specified speeds. In other word, the relative movements are so made that the center of axis 13*a* of the wheel 4 draw approximately semi-circular locus as shown in FIG. 4 i.e., in a manner, that the periferal face to be ground of said wheel 4 repeatedly moves up and down along the periferal face part of the notch of said wafer 2. In this manner, chamfering of the periferal face part of the left half of the notch 2*c* of the wefer 2 as shown in FIG. 3 is carried out. When the wheel 4 reaches the left end part of the notch 2*c* of the wafer 4, the DC servo motor 20 is respectively rotated, by which the wheel 4 is moved in the direction X' by a specified distance LX at a slow speed, by which grinding of the wafer 4 in the circumferential direction is carried out. Simultaneously with this, by driving the DC servo motor 25 and 29 as described above, grinding of the notch of the wafer 2 in the thickness direction of the periferal part thereof is carried out.

In the above chamfering work, the travels of the wheel 4 in the direction X—X' and Z—Z' and the same of the wafer 2 in the direction Y—Y' are sequentially calculated with the real-time position data of the center of the wafer 2 and the axial center 13*a* of the wheel sequentially inputted to the control unit 32 as well as the operation program including the calculation equation stored in advance in the memory (not illustrated) of the control unit 32. The calculation equation is determined according to, for example, the profile of the notch 2*c* of the wafer to be chamfered.

Figure 5:
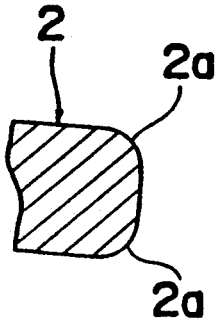

As described above, the relative positional controls of the wheel 4 and the semiconductor wafer 2 in the directions of three axes of X, Y and Z are carried out in such manner that, as for the circumferential direction of the semiconductor wafer 2 as shown in FIG. 3, the wheel 4 is moved along the configuration of the notch 2*c*, and as for the plate thickness of the wafer 2 as shown in FIG. 4, the wheel 4 is relatively moved in the direction of arrow C as shown in FIG. 4, i.e. relatively in the direction of arrow Y by a distance ($LY_2-LY_1$), thereby making it possible to carry out simultaneously chamfering processings r of small arc shape of, for example, 0.01-5.0 mm in Radius on the boundaries 2*e* between the notch 2*c* and the outer circumferential part 2*d* in the circumferential direction and at the root 2*f* of the notch 2*c*, and small arc shaped chamfering at the edges 2*a* in the thickness direction, as shown in FIG. 5. The radius R of a semiconductor wafer 2 as a workpiece is for example 10—400 mm, and the radius $R_2$ to the root 2f of the notch is for example 8–394 mm.

The angle $\alpha$ of the notch 2c is determined corresponding to the production, and an angle of 50°–150° is exemplary used. Even in case of the change in the size of angle $\alpha$, the only step required is to input the changed angular data from the console 33 by means of ten keys therein, and chamfering processing can be carried out without replacing the wheel 4. Further, the size of chamfering may be optionally selected without requirement of replacing the wheel 4.

In the foregoing embodiment, explanation has been given on a controlling system to the directions of X, Y and Z. However, the embodiment is not limited to such controls in the directions of X, Y and Z simultaneously. It may be so designed as to carry out the following sequential steps. Firstly, with stoppage of the rotation of the DC servo motor 25, i.e. with the wheel 4 fixed to a certain Z directional position, only the DC servo motors 20 and 29 are operated. Namely, by the control in the biaxial directions of the direction X and the direction Y, polishing in the outer peripheral direction of the notch 2c is carried out at a certain position in the direction of the thickness of the circumferential face of the wafer 2, followed by operating the DC servo motor 25 to move the wheel 4 slightly in the direction of arrow Z or Z', i.e. to set said wheel 4 at a next chamfering position in the thickness direction of the wafer 2. And, in the same manner as described above, chamfering of the above notch 2c in the outer circumferential direction is carried out. In this manner, the control in the direction of the plate thickness of the notch 2c may be carried out for plural times. In this case, the chamfered configuration of the wafer 2 in the thickness direction becomes a so-called C-face chamfering.

Further, according to the foregoing embodiment, in carrying out chamfering of the edges of the notch 2c of the above wafer 2 in the circumferential direction and the thickness direction, the movement of the wheel 4 in the direction X—X' is controlled by controlling the driving of the DC servo motor 20. Alternatively, in place of this control in the direction of X axis, movements of the workpiece holder 10 or the wafer 4 held thereon may be controlled while the workpiece holder 10 locked in set position rotating at a slow speed by means of the third driving mechanism 11, namely, a so-called $\theta$ directional controlling may be carried out. In this case, the operation equation stored in the memory of the above control unit 32 is typically represented as: $L=f(\theta)$. In this scheme, L is a distance between the grinding face of the wheel 4 and the contour line of the notch 2c of the wafer 2 to be formed.

Further, according to the present invention process, all the edges of the notch 2c in the circumferential direction and the thickness direction are finely ground. Therefore, it is also possible to remove the strain of the semiconductor material produced in the processing of the notch.

While the invention has been particularly shown and described in reference to preferred embodiments thereof, it will be understood by those skilled in the art that changes in form and details may be made therein without departing from the spirit and scope of the invention.

What is claimed is:

1. A method for grinding a notch of a disk-form workpiece, specifically for chamfering the outer peripheral part of the notch of a notched semiconductor wafer with a disk-form grinding wheel, comprising the steps of:

mounting said workpiece on a workpiece holder which rotates so as to rotate said workpiece around the central axis thereof;

arranging a grinding wheel and a workpiece in such positions that flat faces thereof orthogonally cross with each other;

feeding straightly said wheel in an axial direction of the spindle thereof (direction X);

feeding straightly said workpiece in a direction towards and away from said wheel (direction Y); and feeding straightly said wheel in a direction (direction Z) crossing orthogonally with said axial direction (direction X) and said direction towards and away from said wheel (direction Y) to thereby carry out chamfer processing of the outer peripheral part of the notch of said workpiece in the outer peripheral direction and the plate thickness direction.

2. A method for grinding a notch of a disk-form workpiece, specifically for chamfering the outer peripheral part of the notch of a notched semiconductor wafer with a disk-form grinding wheel, comprising the steps of:

arranging a grinding wheel and a workpiece in such positions that flat faces thereof orthogonally cross with each other;

rotating said workpiece around the central axis thereof (direction $\theta$) with a slow speed, said step of rotating said workpiece includes the step of rotating a workpiece holder onto which said workpiece is mounted on;

feeding straightly said workpiece in a direction towards and away from said wheel (direction Y); and feeding straightly said wheel in a direction (direction Z) crossing orthogonally with the direction towards and away from said workpiece (direction Y) to thereby carry out chamfer processing of the outer peripheral part of the notch of said workpiece in the outer peripheral direction and the plate thickness direction.

3. An apparatus for grinding a notch of a disk form workpiece, specifically for chamfering an outer peripheral part of the notched semiconductor wafer with a disk-form grinding wheel, comprising:

a carriage means for supporting said wheel;

a first driving means for feeding straightly the wheel mounted on said carriage in an axial direction of the spindle of said wheel (direction X);

a workpiece holder means for centering said workpiece at a position wherein the plane of the workpiece to be chamfered orthogonally crosses with the plane of said wheel;

a second driving means for moving straightly said carriage in a direction (direction Z) to cross orthogonally with the direction of bringing the workpiece centered and held on said workpiece holder towards and away from said wheel (direction Y);

a third driving means for turning said workpiece holder to turn the workpiece held thereon at a desired angle ($\theta$) with a slow speed;

a fourth driving means for moving said workpiece holder so as to feed straightly the workpiece held on said holder in a direction towards and away from said wheel (direction Y); and a control means for controlling said first, second, third and fourth driving means, wherein chamfer processing of the periperal part of the notch of said workpiece is carried out in the circumferential direction and the thickness direction of the workpiece by moving straightly said wheel and said workpiece so as to make relative displacements in the triaxial direction (directions X or $\theta$, Y and Z) by means of said control means.

* * * * *